US005907625A

United States Patent [19]

Kanai et al.

[11] Patent Number: 5,907,625

[45] Date of Patent: May 25, 1999

[54] PIEZOELECTRIC ELEMENT AND PIEZOELECTRIC ACOUSTIC DEVICE

[75] Inventors: Yasuhiro Kanai; Fumihisa Ito; Hiroshi Ito, all of Tokyo, Japan

[73] Assignee: Taiyo Yuden Co., Ltd., Tokyo, Japan

[21] Appl. No.: 08/664,385

[22] Filed: Jun. 14, 1996

[30] Foreign Application Priority Data

Jul. 31, 1995 [JP] Japan ..... 7-215315

[51] Int. Cl.[6] ..... H04R 25/00

[52] U.S. Cl. ..... 381/190; 381/174

[58] Field of Search ..... 381/174, 190; 310/311, 324

[56] References Cited

FOREIGN PATENT DOCUMENTS 54-92181 12/1952 Japan .
54-21296 2/1979 Japan .
56-48951 11/1981 Japan .

*Primary Examiner*—Sinh Tran
*Attorney, Agent, or Firm*—Flynn, Thiel, Boutell & Tanis, P.C.

[57] ABSTRACT

A piezoelectric element comprises a metallic plate-shaped diaphragm, a plate-shaped piezoelectric body, and electrodes provided on both surfaces of the piezoelectric body, wherein one electrode is fixed to a main surface of the diaphragm. An extension electrode is extended onto a projection projecting from the diaphragm while it is insulated from the diaphragm. The extension electrode is extended from the diaphragm to the projection while it is insulated from the diaphragm. The extension electrode is electrically connected to the electrode which is not fixed to the diaphragm of the piezoelectric body. The piezoelectric element is attached to a case while allowing a main surface of the projection on which the extension electrode is provided to be directed outward. The case is fixed inside a housing of an electronic device, and the projection and the extension electrode are respectively electrically connected to circuit patterns of a printed circuit board mounted inside the housing by way of conductive portions provided on an elastic connection block. With such an arrangement, the case attaching the piezoelectric element thereto can be easily fixed to the electronic device and is easily connected to a circuit without trouble.

5 Claims, 6 Drawing Sheets

PIEZOELECTRIC ELEMENT AND PIEZOELECTRIC ACOUSTIC DEVICE

BACKGROUND OF THE INVENTION

1. Field of the Invention

The present invention relates to a piezoelectric element adapted for an acoustic device such as a receiver of a telephone, etc. and a piezoelectric acoustic device using the same.

2. Prior Art

A conventional piezoelectric acoustic device comprises a case like a tray for accommodating a piezoelectric element therein, a stepped piezoelectric element support provided at an inner peripheral side of the case at the intermediate portion thereof, wherein a peripheral portion of a diaphragm is placed on and fixed to the piezoelectric element support by an adhesive. In the piezoelectric element, one of the electrodes provided on both surfaces of a plate-shaped piezoelectric body is bonded to a surface of the diaphragm wherein lead wires are respectively connected to the electrode on the piezoelectric element and the diaphragm and are extended outside the case.

Such a piezoelectric acoustic device is incorporated into an electronic device such as a portable telephone, a so-called cordless phone, and it is accommodated in a housing of the electronic device with a consideration to its interchangeability when defective, and finally fixed to the housing by screws, etc. Further, the lead wires are connected to a printed circuit board in the housing by soldering, etc.

In addition to the piezoelectric acoustic device connected by the lead wires, there is a piezoelectric acoustic device having no lead wires wherein conductive pins provided in the case contact the diaphragm and the electrodes of the piezoelectric element so as to connect to the circuit. This piezoelectric acoustic device is also accommodated in the housing of the electronic device and is fixed to the housing by screws, etc.

However, in the aforementioned piezoelectric acoustic devices, it is necessary to fix the case attaching the piezoelectric element thereto to the housing by screws, which is troublesome when incorporating the case into the housing. When exchanging the case with another case, the screws are unscrewed and removed and the another new case is fixed to the housing by screws, which is very troublesome. Further, in the piezoelectric acoustic device having the circuit therein which is connected to the piezoelectric acoustic device by lead wires, when the case having the piezoelectric element attached thereto is fixed to the housing, the lead wires must be soldered. When the piezoelectric element is exchanged for another one, the solder of the lead wires must be melted and separated from the circuit, and a new piezoelectric element must be soldered afresh. In any of the piezoelectric acoustic devices, it is very troublesome.

SUMMARY OF THE INVENTION

In view of the drawbacks of the conventional piezoelectric acoustic device, it is an object of the invention to provide a piezoelectric element and piezoelectric acoustic device in which a case having a piezoelectric element thereto is easily fixed to an electronic device, and is connected to a circuit without taking time and labor. Accordingly, the electronic device can be easily assembled and the piezoelectric element can be easily exchanged for another one.

To achieve the above object, in the present invention, a projection is provided on a periphery of a metallic plate-shaped diaphragm of a piezoelectric element, and an extension electrode electrically extended onto a main surface of the projection and electrically connected to an electrode which is not fixed to the diaphragm of a plate-shaped piezoelectric body while allowing the extension electrode to be insulated from the diaphragm. The extension electrode and the projection are electrically connected to circuit patterns on the printed circuit board 36 which is accommodated in a housing of an electronic device by way of conductive portions of an elastic connection block.

A piezoelectric element comprises the diaphragm, electrodes provided on both main surfaces of the piezoelectric body, one of the electrodes being fixed and electrically connected to a main surface of the diaphragm. The piezoelectric element further comprises the projection projecting from the diaphragm, and an extension electrode being extended onto the projection while it is insulated from the diaphragm and electrically connected to another electrode, which is not fixed to the diaphragm of the piezoelectric body.

The piezoelectric acoustic device uses the aforementioned piezoelectric element, which is attached to the case while a main surface side of the projection having the extension electrode provided thereon is directed outward. Further, the case having the piezoelectric element attached thereto is fixed to an inner portion of a housing of an electronic device, and the projection and the extension electrode are respectively electrically connected to circuit patterns of a printed circuit board mounted on the inner portion of the housing by way of conductive portions provided in an elastic connection block. In this case, the case having the piezoelectric element attached thereto is clamped inside the housing of the electronic device, and the connection block is clamped between the projection supported by an electrode supporting portion of the case and the printed circuit board while compression stress is given therebetween.

The connection block is an elastic block having a plurality of conductive portions provided at least on the surface thereof, wherein the conductive portions are arranged alternately in a given interval while having insulation provided therebetween. The case includes a holding means for holding the connection block and temporarily fixing the connection block thereto when the piezoelectric acoustic device is incorporated into the housing of the electronic device.

In the aforementioned piezoelectric acoustic device, the extension electrode provided on the projection of the diaphragm and the surface of the projection are connected to the circuit patterns of the printed circuit board by the elastic connection block, which dispenses with soldering of the lead wires. The case having the piezoelectric element attached thereto is clamped inside the housing of the electronic device, which dispenses with fixing of the case by screws, etc. That is, the case having the piezoelectric element attached thereto is clamped inside the housing of the electronic device, and the connection block is clamped between the projection supported by the electrode supporting portion of the case and the printed circuit board while compression stress is given therebetween by merely incorporating the case having the piezoelectric element attached thereto into the housing and fixing the housing in a given condition. When the housing is disassembled, the case 1 can be easily separated from the housing. As a result, the piezoelectric acoustic device can be easily assembled and disassembled.

Since the connection block is an elastic block having a plurality of conductive portions which are provided at least on the surface thereof and are arranged alternately in a given interval while being insulated therebetween, when the connection block is clamped between the projection supported by the electrode supporting portion of the case and the printed circuit board while compression stress is given therebetween, the diaphragm and the electrodes of the piezoelectric body can be easily connected to the circuit patterns of the printed circuit board. Particularly, if the case includes a holding means for holding the connection block, when the piezoelectric acoustic device is incorporated into the housing of the electronic device, the connection block can be temporarily fixed to the case, which enhances the incorporation of the piezoelectric acoustic device into the housing.

BRIEF DESCRIPTION OF THE DRAWINGS

FIG. 1(*b*) is a longitudinal cross-sectional side view of the piezoelectric acoustic device when it is assembled;

PREFERRED EMBODIMENT OF THE INVENTION

Figure 1A:
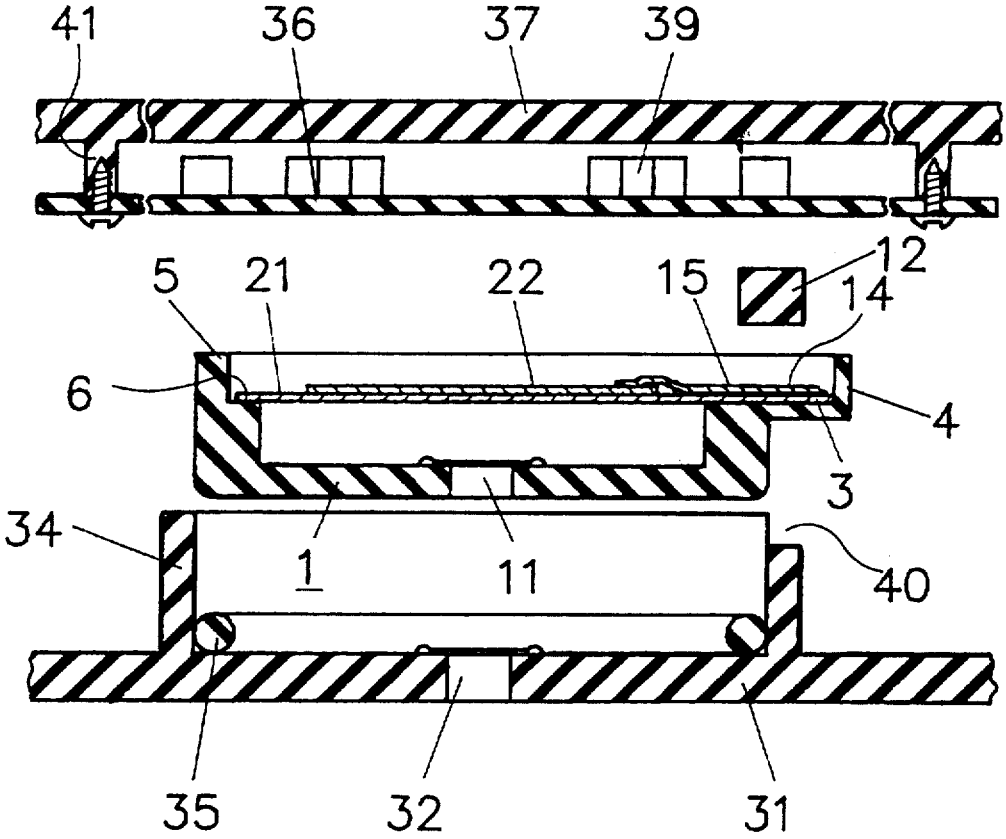
FIG. 1(*a*) is an exploded longitudinal cross-sectional side view of a piezoelectric acoustic device when it is disassembled according to a first embodiment of the invention.

A preferred embodiment of the invention will be now described in detail with reference to the attached drawings. First Embodiment (FIG. 1 through FIG. 9):

FIGS. 1 through 5 show a first embodiment which applies the invention to a piezoelectric receiver. A case 1 is formed like a tray having an upper opened surface and made of a resin. A sound damper 11 comprises a hole which is bored at the central bottom portion of the case 1 and covered with a mesh made of Tetoron (trademark) having about #380 meshes. The sound damper 11 can be any suitable shape of various shapes depending on the acoustic characteristics to be obtained, for example, it can be formed of a plurality of small sound emitting holes. A sound damper having a large diameter may be covered with damper cloth, etc.

An electrode supporting portion 4 projects from several portions of a peripheral wall 5 of the case 1. The electrode supporting portion 4 is like a groove having inner dimensions corresponding to the dimensions of a projection 3 which projects radially from a peripheral portion of a diaphragm 21 of a piezoelectric element 2, described later. The electrode supporting portion 4 projects radially from an outer peripheral portion of the case 1. A step 6 is formed on an inner peripheral wall 5 of the case 1 at the middle portion thereof in the direction of the inner height of the peripheral wall 5 and extends along the entire periphery of the case 1 excluding a lead wire drawing groove for supporting the peripheral portion of the diaphragm 21 of the piezoelectric element 2.

Figure 2:
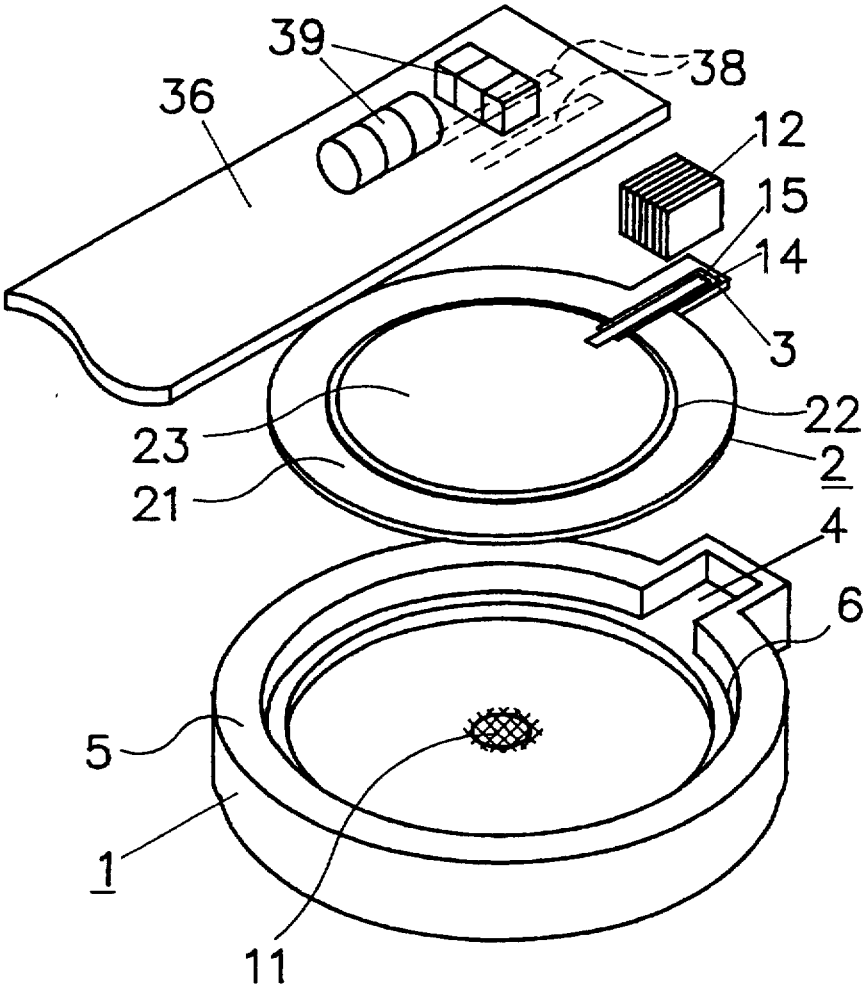
FIG. 2 is an exploded perspective view of an electric device employed by the piezoelectric acoustic device of FIG. 1 excluding a housing therefore.

As shown in FIGS. 2 through 5, the piezoelectric element 2 comprises a plate-shaped piezoelectric body 22 made of a piezoelectric ceramic, etc., and electrodes 23 provided on both main surfaces of the piezoelectric body 22 (only one of the electrodes 23 is seen and illustrated in FIGS. 2. through 5). One of the electrodes 23 of the piezoelectric body 22 is fixed and electrically connected to the metallic diaphragm 21. The diaphragm 21 and the piezoelectric body 22 of the piezoelectric element 2 are respectively circular. The diameter of the diaphragm 21 of the piezoelectric element 2 is slightly greater than the inner diameter of the step 6 of the case 1, and is slightly less than the inner diameter of the peripheral wall 5 at the upper portion of the step 6.

Figure 3:
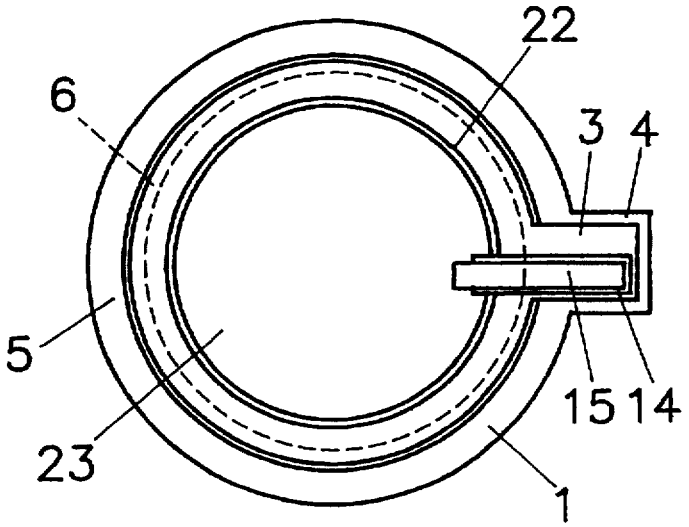
FIG. 3 is a plan view showing a state where the piezoelectric element is attached to a case of the piezoelectric acoustic device of FIG. 3.
Figure 4:
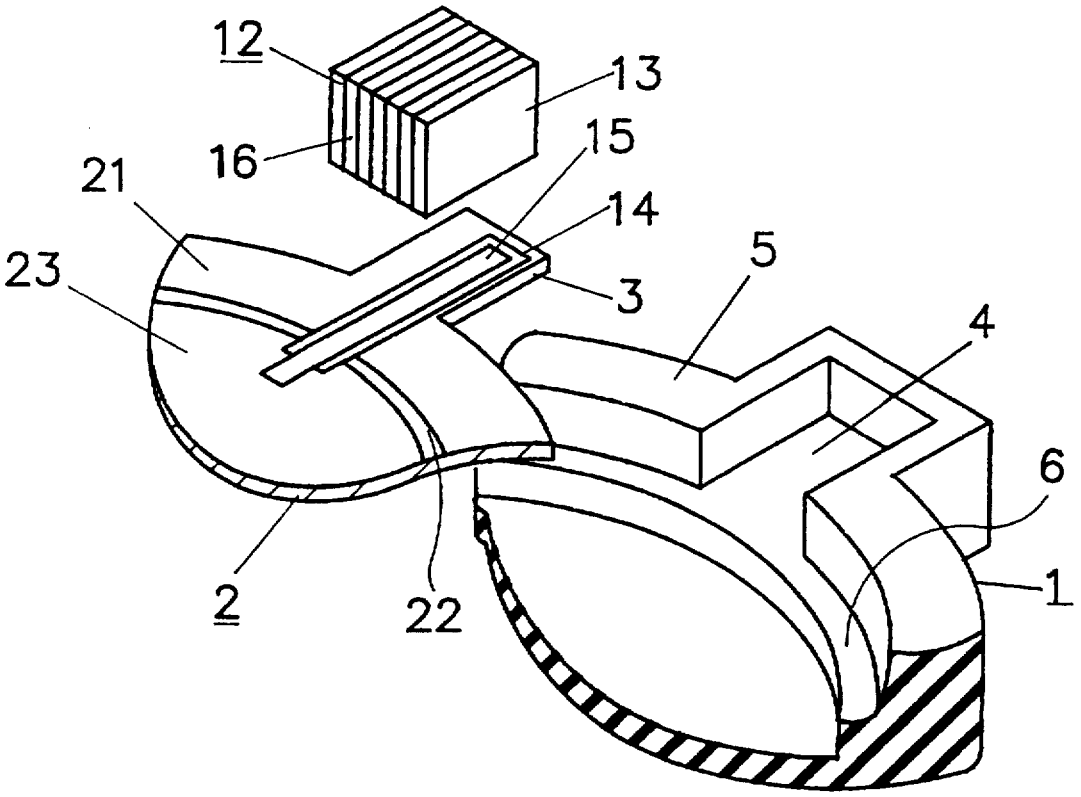
FIG. 4 is an exploded perspective view showing a main portion of the electric device employing the piezoelectric acoustic device of FIG. 1 excluding a housing therefore.
Figure 5:
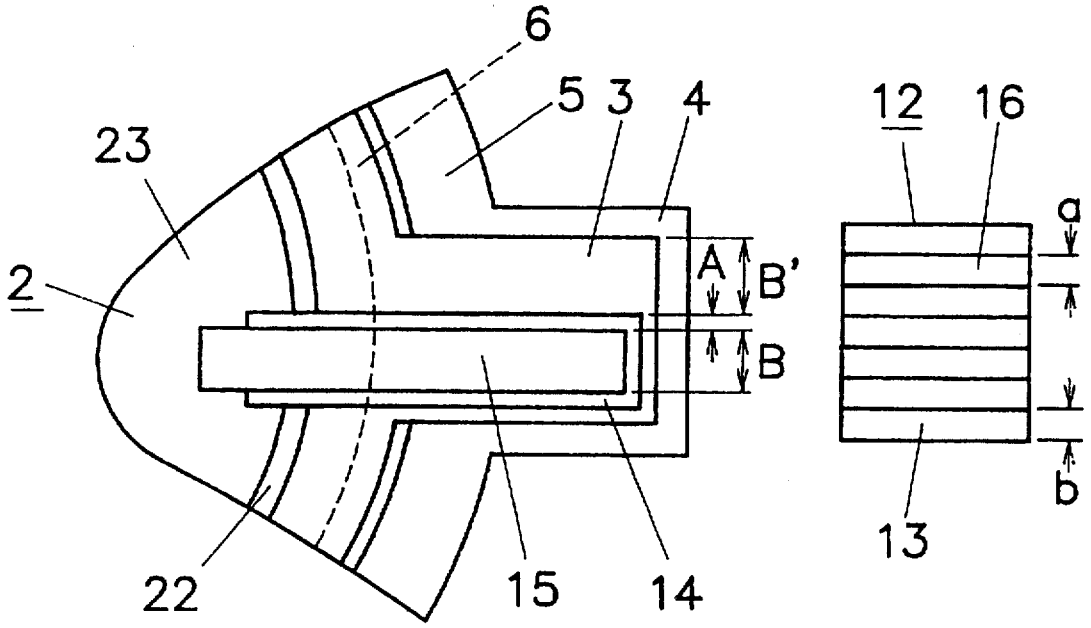
FIG. 5 is a plan view showing a state where a main portion of the piezoelectric element is attached to the case of the piezoelectric acoustic device of FIG. 4.

As shown in FIGS. 1 through 5, the projection 3 projects from the peripheral portion of the diaphragm 21 and also projects radially, i.e. in a direction of the radius of the diaphragm 21. A belt-shaped insulating layer 14 is formed to extend from the electrodes 23 of the piezoelectric body 22 to the projection 3. A belt-shaped extension electrode 15 composed of a conductive film is formed on the insulating layer 14. The extension electrode 15 extends over an edge of the end of the insulating layer 14 at the side of the electrodes 23 of the piezoelectric body 22 wherein the end portion of the extension electrode 15 contacts the electrodes 23 so that the extension electrode 15 is electrically connected to the electrodes 23. As shown in FIG. 5, the insulating layer 14 and the extension electrode 15 are respectively deflected on the projection 3, namely, formed at one side of the projection 3, while the metallic surface of the projection 3 is exposed at the other side of the projection 3. In FIG. 5, the width of the extension electrode 15 is denoted at B and the width of the portion of the projection 3 where the metallic surface is exposed is denoted at B'. The margin between the edge of the extension electrode 15 and that of the insulating layer 14 is denoted as A.

Further, according to the piezoelectric acoustic device of this embodiment, a connection block 12 shown in FIGS. 4 and 5 is prepared. The connection block 12 is a block as disclosed, e.g. in Japanese Patent Publication No. 56-48951, or an elastic block which is commercially available under the name of "INTERCONNECTOR", wherein insulating portions 13 and conductive portions 16 are arranged alternately in a given pitch at least on a surface of the elastic block 12. For example, the connection block 12 is formed of a layered body in which elastic insulating bodies and elastic conductive bodies having a given thickness are respectively alternately layered, or it is formed of an elastic block in which a surface of the connection block 12 is metalized in a given interval like a belt.

The width of the connection block 12 is slightly greater than the inner dimensions of the electrode supporting portion 4 of the case 1. Each width of the insulating portions 13 is denoted at b and each width of the conductive portions 16 is denoted at a. The following dimensional relations or expressions are established between the extension electrode 15, the insulating layer 14, and the metallic surface of the projection 3.

A>a, B>b, B'>b.

To incorporate the piezoelectric element 2 having such an arrangement into the case 1, an adhesive such as a silicon adhesive is uniformly coated previously on the step 6 within the inner periphery of the peripheral wall 5 of the case 1 provided with the sound damper 11 which includes damper means such as a damper cloth or pin hole damper. Next, the piezoelectric element 2 is accommodated inside the case 1 while the piezoelectric body 22 is directed upward, and the peripheral portion of the diaphragm 21 of the piezoelectric element 2 is placed on and fixed to the step 6 by the adhesive. At this time, the projection 3 is engaged in the electrode supporting portion 4 of the case 1. It is possible to select a suitable shape and structure of the sound damper 11 among various shapes and structure depending on the acoustic characteristics to be obtained. In such a manner, the piezoelectric element 2 is attached to the case 1 as shown in FIG. 3.

Figure 1B:
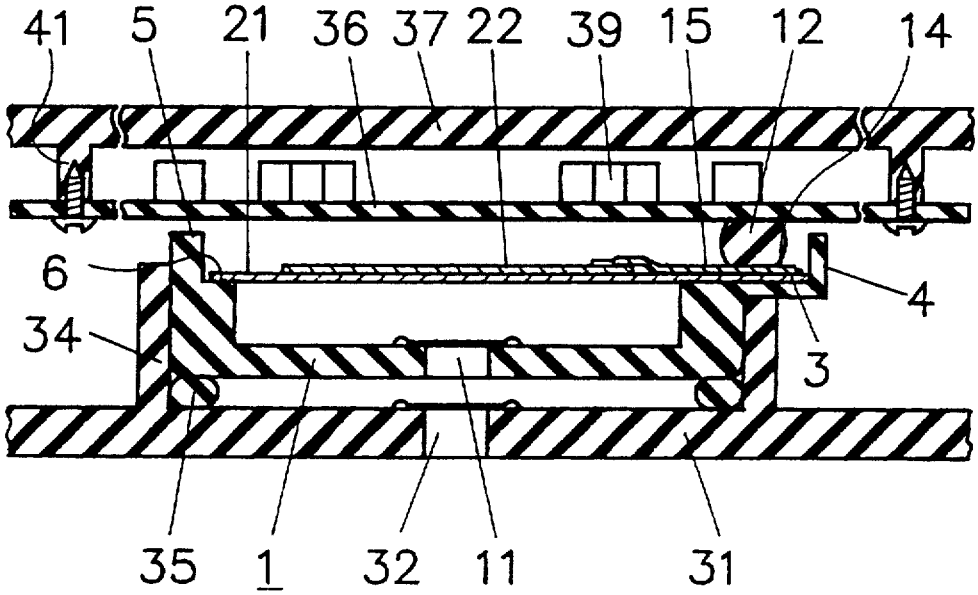

FIG. 1 shows a housing of an electric device such as a portable telephone or a cordless phone in which the case 1 having the piezoelectric element 2 attached thereto is incorporated. The housing in FIG. 1 comprises a pair of half members 31 and 37, which can be assembled to form the housing.

A peripheral wall-shaped case attaching portion 34 rises on an interior of the half member 31 constituting the housing, and the inner diameter of the case attaching portion 34 is slightly greater than the outer diameter of the case 1. A recess 40 corresponding to the outer width of the electrode supporting portion 4 of the case 1 is provided at a part of the case attaching portion 34. Sound emitting holes 32 are positioned at the center of the portion encompassed by the case attaching portion 34 of the half member 31, and they may be airtightly covered by a water-proof sheet, a cloth, etc., for preventing water, dust, etc., from entering therein, if need be.

A printed circuit board 36 is supported or held by a board support portion 41 projecting from the inner surface of the other half member 37 within the other half member 37, wherein circuit patterns 38 and 38 (refer to FIG. 2) to be connected to the diaphragm 21 and the electrodes 23 of the piezoelectric element 2 are provided on the lower surface of the printed circuit board 36 in FIG. 1. In FIG. 1, denoted at 39 is a circuit component mounted on the printed circuit board 36 and it constitutes circuits for driving the piezoelectric element 2, etc.

To incorporate the case 1 having the piezoelectric element 2 attached thereto into the housing as shown in FIG. 1(*a*), firstly the half member 31 is disposed in a manner such that the case attaching portion 34 is directed upward, secondly, a ring-shaped elastic member 35, such as an O-ring, is engaged in the inner bottom portion of the case attaching portion 34, thirdly, the case 1 is engaged in the case attaching portion 34 while the piezoelectric element 2 is directed upward, and finally the electrode supporting portion 4 is engaged in the recess 40 of the case attaching portion 34.

Successively, the connection block 12 is engaged inside the electrode supporting portion 4. Since the width of the connection block 12 is slightly greater than the inner dimensions of the electrode supporting portion 4, the connection block 12 is slightly compressed in the width direction and engaged in the electrode supporting portion 4. Accordingly, the connection block 12 is temporarily fixed inside the groove of the electrode supporting portion 4 so that it is prevented from dropping off. In this state, the half member 31 is put on the other half member 37, then these half members are fixed to each other by screws, not shown, thereby assembling the housing.

FIG. 1(*b*) shows a state where the housing is assembled, the case 1 is clamped between the half members 31 and 37 in a state where the elastic member 35 is compressed in the vertical direction, i.e., toward the direction of the height of the elastic member 35. Particularly, in the first embodiment shown in FIG. 1(*b*), the board support portion 41, on which the printed circuit board 36 is mounted, presses the case 1 downward. The pressing force and repulsive force from the half member 31 compress the elastic member 35. As a result, the case 1 is fixed inside the housing, even if fastening members such as screws are not used. The printed circuit board 36 does not strike against the case 1, and hence it does not receive a repulsive force so that it is not bent. Further, in this state, the connection block 12 is slightly compressed in the direction of its height and fixed to the electrode supporting portion 4. The extension electrode 15 and the metallic surface of the projection 3 are respectively connected to the circuit patterns 38 of the printed circuit board 36 (refer to FIG. 2) by way of the conductive portions 16 of the connection block 12 (refer to FIGS. 4 and 5). As a result, the piezoelectric element 2 is connected to the circuit component 39 mounted on the printed circuit board 36 including the circuit for driving the piezoelectric element 2.

A plurality of through holes are provided in the printed circuit board 36 without preventing the oscillation of the piezoelectric element 2 or a groove is provided on at least one side of the surface where the case 1 and the printed circuit board 36 contact each other so as to assure ventilation.

Figure 6A:
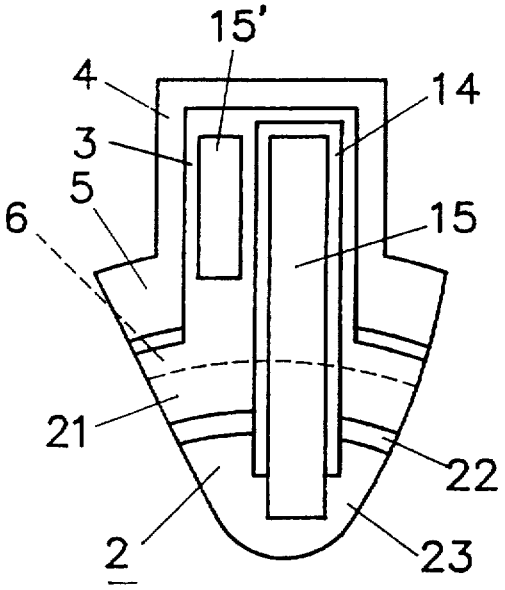
FIGS. 6(*a*) and 6(*b*) are plan views showing main portions of projections of diaphragms of the piezoelectric acoustic device according to a modification of the first embodiment of the invention.
Figure 6B:
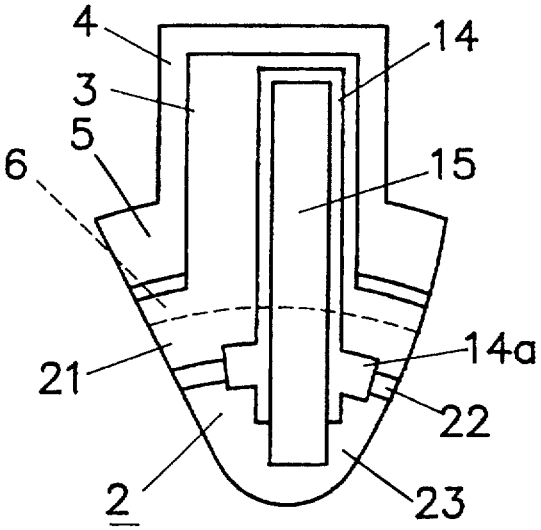

Other examples of the projection 3 are illustrated in FIGS. 6(*a*) and 6(*b*). In FIG. 6(*a*), the extension electrode 15 is formed on the projection 3 and a conductive film 15', like the extension electrode 15, is formed on the metallic surface portion of the projection 3 abutting the extension electrode 15. The conductive film 15' is formed for solving the problem of the formation of a step between the extension electrode 15 on the insulating layer 14 and the metallic surface portion of the projection 3 at one side of the projection 3. When this problem is solved, the compression distortion of the connection block 12 is prevented from deflecting at a specific portion on the electrode supporting portion 4. In FIG. 6(*b*), the width of the insulating layer 14 is largely formed at a stepped portion at an edge of the piezoelectric body 22 on the diaphragm 21, which can cope with dispersion caused by a sag in printing at the stepped portion of the extension electrode 15, and can assure the insulation relative to the diaphragm 21.

Figure 7A:
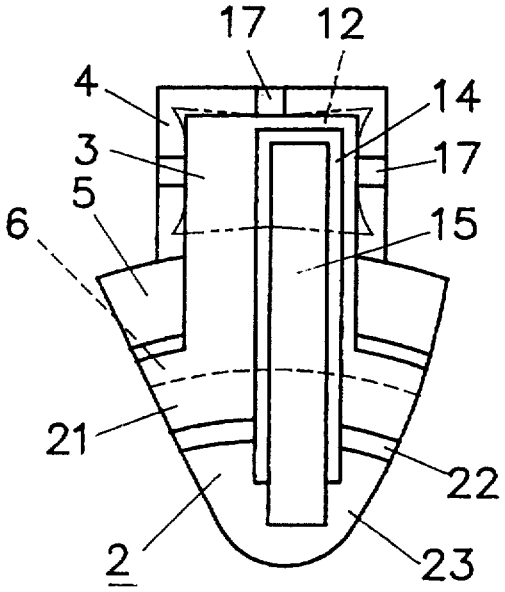
FIGS. 7(*a*) and 7(*b*) are plan views showing main portions of electrode supports of the case of the piezoelectric acoustic device according to a modification of the first embodiment.
Figure 7B:
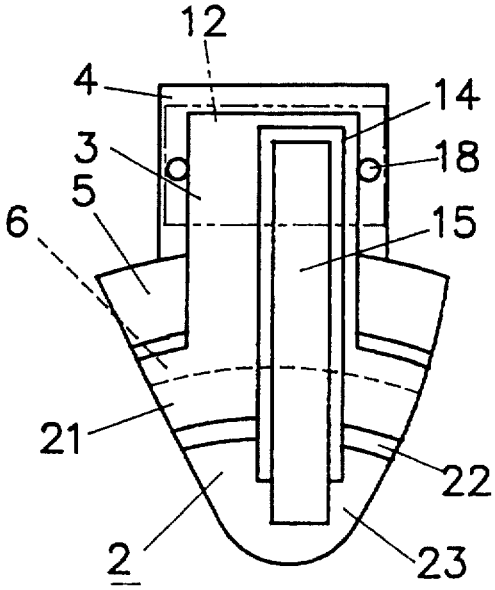

Other examples of the electrode supporting portion 4 of the case 1 are illustrated in FIGS. 7(*a*) and 7(*b*). That is, in FIG. 7(*a*), the electrode supporting portion 4 is not formed like the groove but projections 17, 17 . . . are provided at the tip and both sides of the electrode supporting portion 4. The connection block 12 deforms and engages in the electrode supporting portion 4 to be fixed to the electrode supporting portion 4. Compared with the engagement of the connection block 12 into the groove-shaped electrode supporting portion 4, the connection block 12 can be easily incorporated into the electrode supporting portion 4 in FIG. 7(*a*). In FIG. 7(*b*), the electrode supporting portion 4 is not groove-shaped but flat-plate-shaped, wherein two projections 18 and 18 project from the electrode supporting portion 4 at the position not to overlap with the projection 3 of the diaphragm 21, and they engage with holes provided in the connection block 12 so as to hold the connection block 12. Compared with the engagement of the connection block 12 into the groove-shaped electrode supporting portion 4, the connection block 12 can be easily incorporated into the electrode supporting portion 4 in FIG. 7(*b*).

Figure 8:
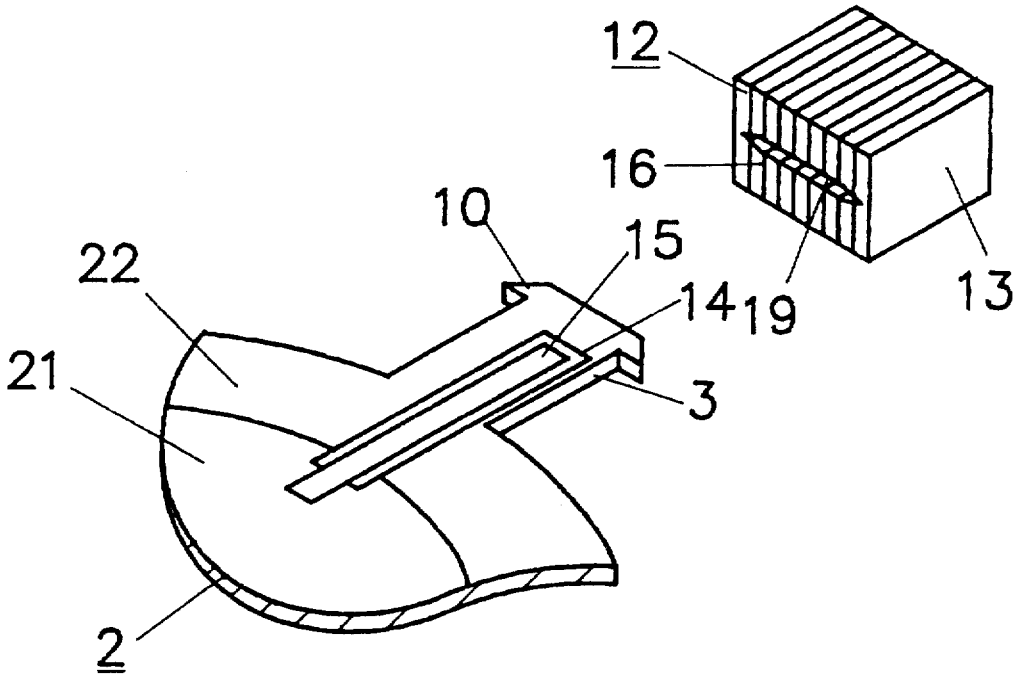
FIG. 8 is an exploded perspective view showing another example of a main portion of a temporary fixing means for fixing a connection block to the projection of the diaphragm.
Figure 9:
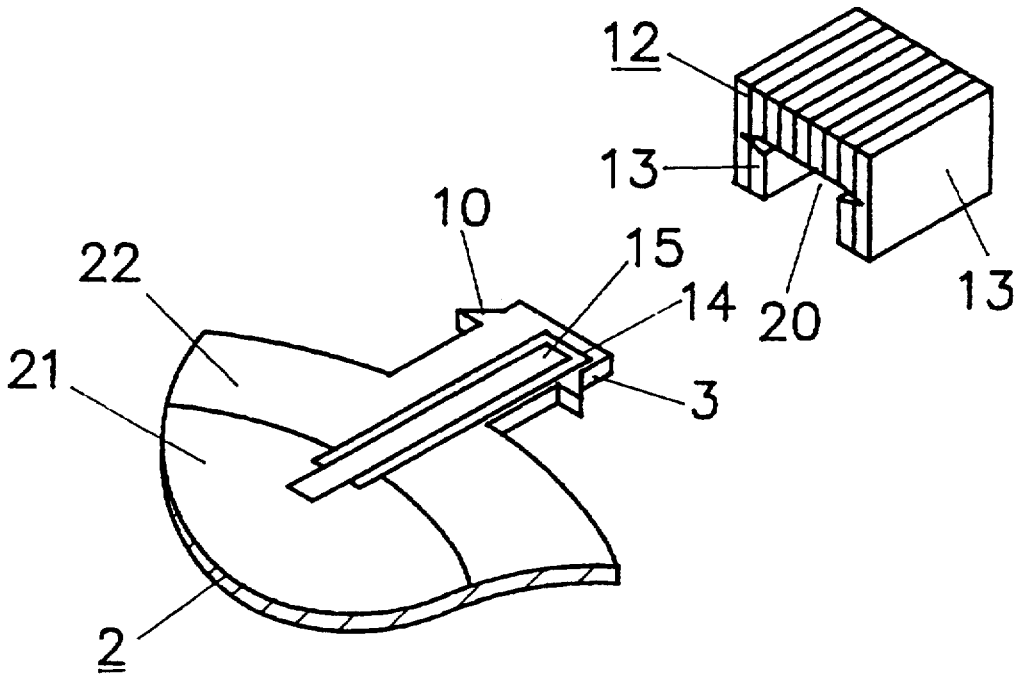
FIG. 9 is an exploded perspective view showing a still another example of a main portion of a temporary fixing means for fixing the connection block to the projection of the diaphragm.

FIGS. 8 and 9 show other examples of a temporary fixing means of the connection block 12.

In FIG. 8, a slit 19 is provided laterally at the center of the connection block 12, and the projection 3 of the diaphragm 21 is inserted into the slit 19 so as to temporarily fix the connection block 12. In this case, so-called return protrusions 10 and 10 are provided at both sides of the tip of the projection 3 to prevent the connection block 12 from dropping off. In FIG. 9, a notch 20 is provided at a lower half portion of the connection block 12 at the center thereof so that the projection 3 of the diaphragm 21 is inserted into the notch 20 to temporarily fix the connection block 12. In this case, so-called return protrusions 10 and 10 are provided at both sides of the central portion of the projection 3 to prevent the connection block 12 from dropping off. Any of the connection blocks 12 in FIGS. 8 and 9 can be easily incorporated into the electrode supporting portion 4 compared with the engagement of the connection block 12 into the groove-shaped electrode supporting portion 4. In the embodiment shown in FIGS. 8 and 9, it is preferable to support the lower surface side of the projection 3 of the diaphragm 21 directly by the electrode supporting portion 4 or by way of other members.

Figure 10:
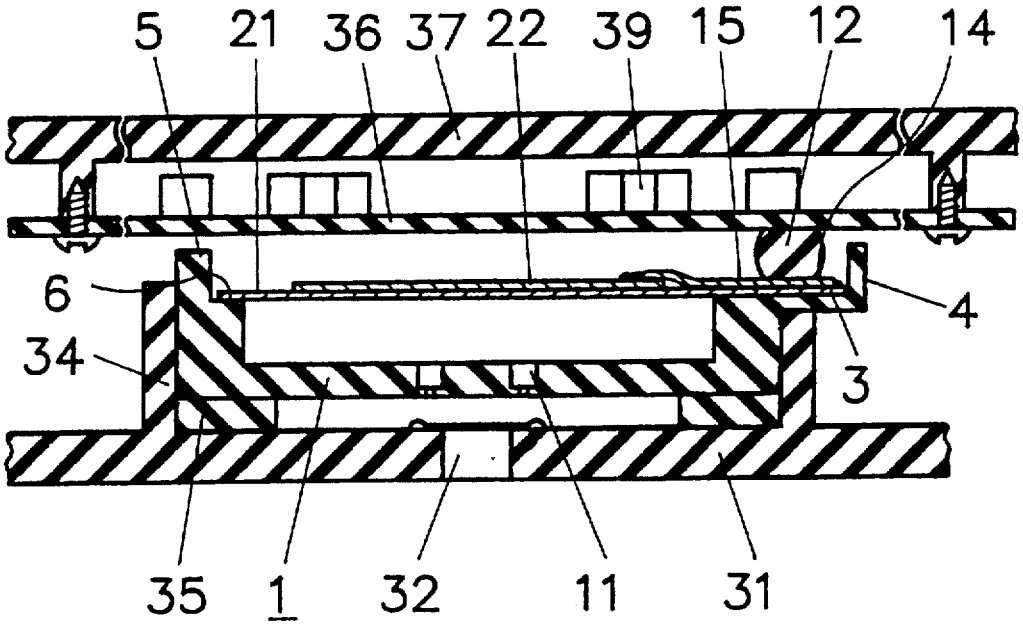
FIG. 10 is a longitudinal cross-sectional side view of the piezoelectric acoustic device according to a second embodiment of the invention when assembled.

Second Embodiment (FIGS. 10 and 11):

FIG. 10 shows a piezoelectric element and piezoelectric acoustic device according to a second embodiment of the invention.

As the elastic member 35, an adhesive is coated on one surface or both surfaces of a base member 42 formed of isobutylene-isoprene rubber, acrylic foam, etc., instead of the O-ring in the first embodiment. Using an elastic member 35 having such an adhesive surface, the case 1 can be temporarily fixed to the one half member 31 of the housing when assembling the housing. After the housing is assembled, the case 1 can be firmly and stably held by the housing.

Figure 11A:
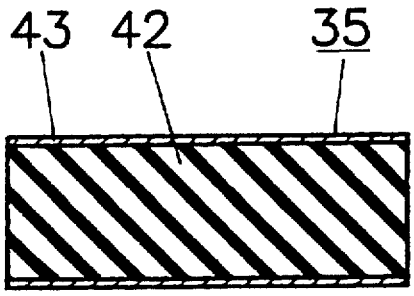
FIGS. 11(*a*) and 11(*b*) are cross-sectional views each showing an elastic member employed by the piezoelectric acoustic device according to the second embodiment of the invention.
Figure 11B:
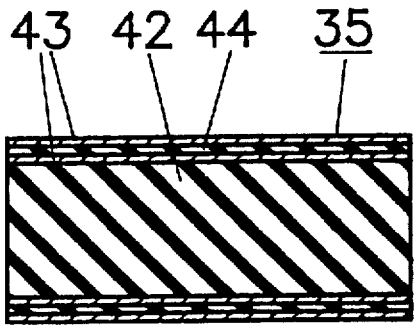

FIGS. 11(*a*) and 11(*b*) show examples of the elastic members in FIG. 10. In FIG. 11(*a*), an adhesive 43 is directly coated on both surfaces of the base member 42 formed of isobutylene-isoprene rubber, acrylic foam, etc. In FIG. 11(*b*), adhesive tapes are bonded on both surfaces of the base member 42. The adhesives 43 and 43 are coated on both main surfaces of a tape 44 formed of polyethylene terephthalate film, paper sheet, etc., and each adhesive coated on one main surface of the tape 44 is bonded to both surfaces of the main surface of the base member 42.

What is claimed is:

1. In a piezoelectric acoustic device comprising a piezoelectric element having a metallic plate-shaped diaphragm, a plate-shaped piezoelectric body, electrodes provided on both main surfaces of the piezoelectric body, one electrode being fixed and electrically connected to a main surface of the diaphragm, and a case for accommodating the piezoelectric element therein and forming a resonant chamber together with the piezoelectric body, said piezoelectric element further comprising a projection projecting from the diaphragm and an extension electrode, said extension electrode being extended onto the projection while being insulated from the diaphragm and electrically connected to another electrode which is not fixed to the diaphragm of the piezoelectric body, said piezoelectric element being attached to the case while allowing a main surface of the projection having the extension electrode attached thereto to be directed outward, the case having the piezoelectric element attached thereto being fixed inside a housing of an electronic device, and a metallic surface portion of the projection and the extension electrode are respectively electrically connected to a circuit pattern of a printed circuit board mounted inside the housing by way of conductive portions provided on an elastic connection block.

2. A piezoelectric acoustic device according to claim 1, wherein the connection block is clamped between the projection supported by an electrode supporting portion and the printed circuit board while compression stress is provided therebetween.

3. A piezoelectric acoustic device according to claim 1, wherein the case having the piezoelectric element attached thereto is clamped inside the housing of the electronic device.

4. A piezoelectric acoustic device according to claim 1, wherein the case includes a holding means for holding the connection block.

5. A piezoelectric acoustic device according to claim 1, wherein the connection block is an elastic block having a plurality of conductive portions provided at least on the surface thereof, and wherein the conductive portions are arranged alternately in a given interval with insulation provided therebetween.

* * * * *